United States Patent [19]

Cheng

[11] 4,203,548

[45] * May 20, 1980

[54] MODEL TRACK SECTION

[76] Inventor: Richard C. M. Cheng, Suite 1604, Austin Center, Austin Ave., Kowloon, Hong Kong, B.C.C.

[ * ] Notice: The portion of the term of this patent subsequent to Apr. 18, 1995, has been disclaimed.

[21] Appl. No.: 831,377

[22] Filed: Sep. 8, 1977

Related U.S. Application Data

[63] Continuation-in-part of Ser. No. 717,581, Aug. 25, 1976, Pat. No. 4,084,746.

[51] Int. Cl.[2] ..... A63H 19/30

[52] U.S. Cl. ..... 238/10 F

[58] Field of Search ..... 238/1 R, 1 A, 1 B, 10 C, 238/10 E, 10 F; 104/53, 60, 147 A, 149; 46/1 K, 216; 191/22 C

[56] References Cited

U.S. PATENT DOCUMENTS

| | | | |
|---|---|---|---|
| 1,142,150 | 6/1915 | Durrill | 238/10 E |
| 3,140,825 | 7/1964 | Edmondson | 238/10 F |
| 3,206,122 | 9/1965 | Frisbie et al. | 238/10 F |
| 3,520,475 | 7/1970 | Ernst | 238/10 F |
| 4,066,211 | 1/1978 | Mak | 238/10 F |
| 4,081,133 | 3/1978 | Tong | 46/1 K X |
| 4,082,220 | 4/1978 | Cheng et al. | 238/10 C X |
| 4,084,746 | 4/1978 | Cheng | 238/10 F |

*Primary Examiner*—Randolph A. Reese
*Attorney, Agent, or Firm*—Robert K. Youtie

[57] ABSTRACT

A model track section for model vehicles including a first formation on each end having one side facing laterally, an obliquely disposed resilient element on the one side of each first formation and deflectable toward the latter, a complementary formation on each end of the body engageable with a resilient element to effect the lateral deflection upon end-to-end engagement with a like track section, a guide on the section ends for constraining like sections to aligned longitudinal movement, and retaining element on the track section ends for releasable retaining engagement with a like track section.

3 Claims, 5 Drawing Figures

FIG. 1
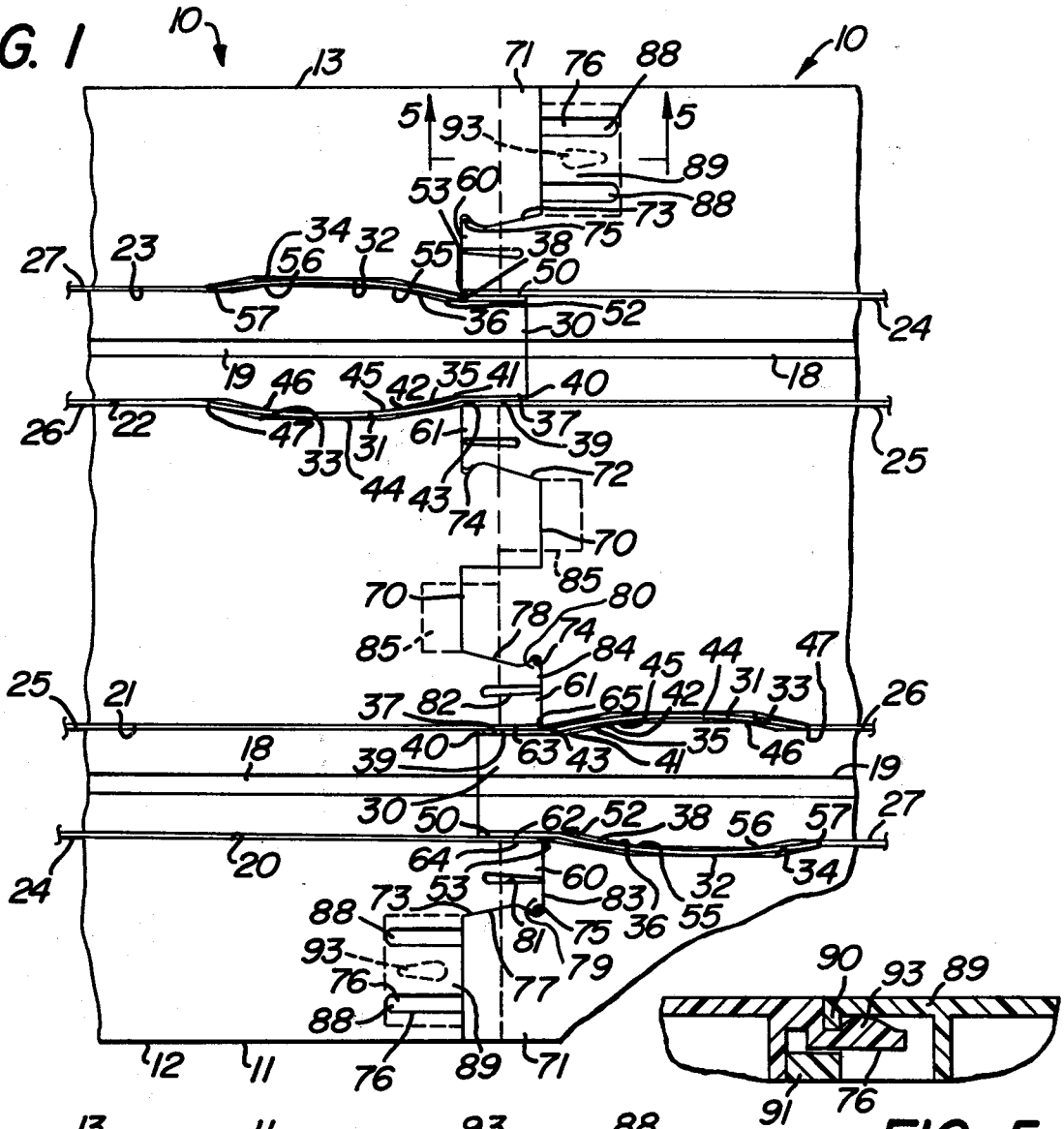
FIG. 5
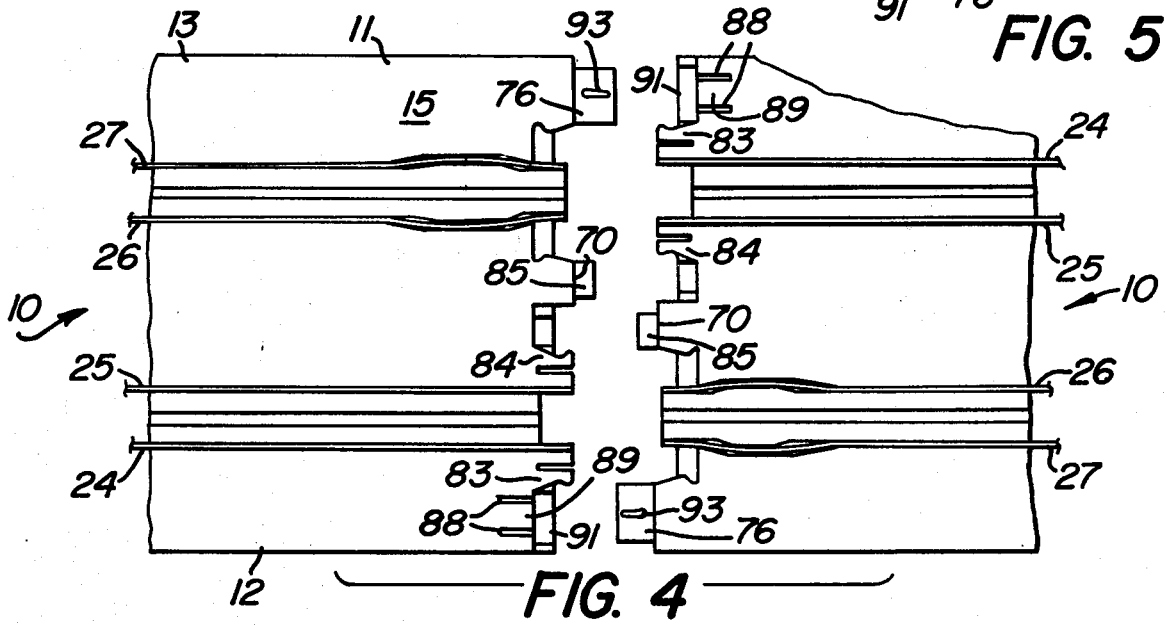
FIG. 4

MODEL TRACK SECTION

CROSS REFERENCES TO RELATED APPLICATIONS

This application is a continuation-in-part of my copending patent application Ser. No. 717,581, filed Aug. 25, 1976 and now U.S. Pat. No. 4,084,746.

BACKGROUND OF THE INVENTION

The prior art in model track for model vehicles often require skill and dexterity to assemble one track section with another. Also, in manufacture of prior model track sections for model vehicles, the fabrication of conductor strips or rails usually involve one or more forming operations, resulting in strips requiring a specific orientation for assembly with the roadbed body. Obviously, the rail forming operations and specific orientation of rails relative to bodies involve manufacturing time and expense.

SUMMARY OF THE INVENTION

It is, therefore, an important object of the present invention to provide a model track construction which overcomes the above-mentioned difficulties, is uniquely simple in being automatically longitudinally aligning in the track section connection operation. This enables even relatively small children and uncoordinated persons to assemble or connect the track sections quickly and easily, without damage.

It is another object of the present invention to provide a track section of the type described wherein the conductor strips or rails are uniquely simple in construction, being generally straight or undeformed, and generally of constant cross-sectional configuration, so as to require only a cut-off operation from strip stock, for effecting substantial economies in rail strip fabrication.

It is still another object of the present invention to provide a track section having the advantageous characteristics mentioned in the preceding paragraphs, wherein the conductor strip or rail is symmetrical about its various axes for assembly with a track section body in any random orientation, to achieve substantial economies in the manufacturing and assembly costs.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described and of which the scope will be indicated by the appended claims.

BRIEF DESCRIPTION OF THE DRAWINGS

FIG. 1 is a top plan view showing a pair of track sections of the present invention in end-to-end assembled relation, the nonadjacent ends being broken away to facilitate enlargement and clarity.

FIG. 4 is a top plan view of the track sections in disconnected condition.

FIG. 5 is an enlarged partial sectional elevational view taken generally along the line 5—5 of FIG. 1.

DESCRIPTION OF THE PREFERRED EMBODIMENT

Figure 2:
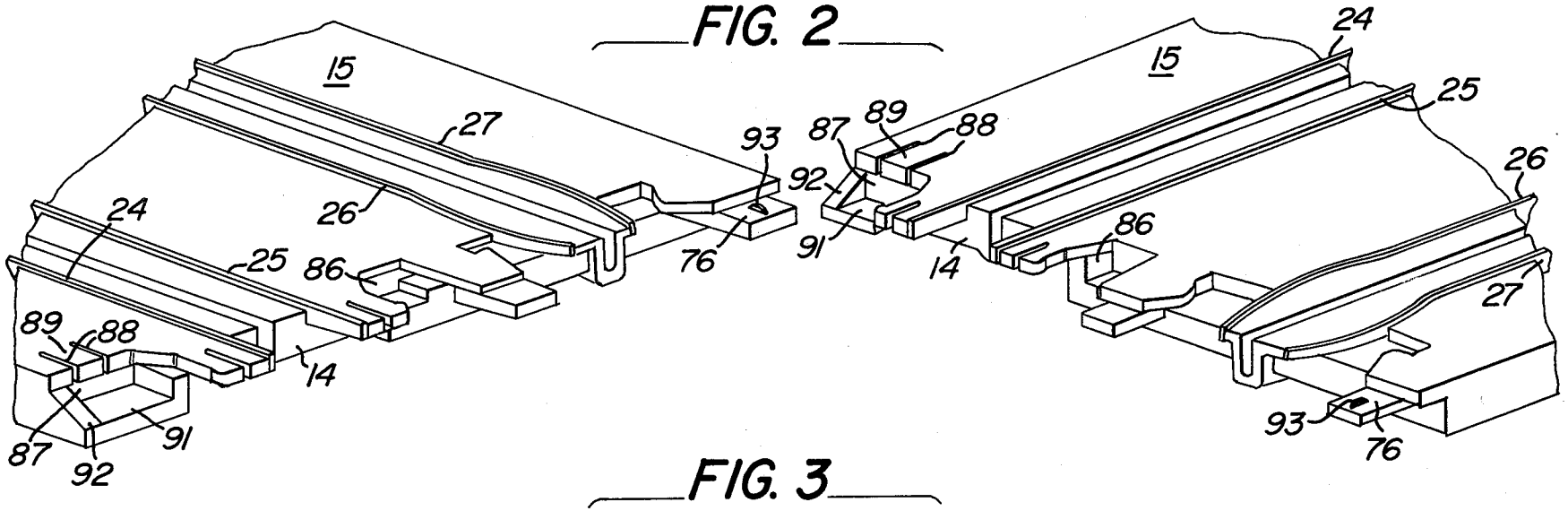
FIG. 2 is a partial top end perspective view showing disconnected track sections of FIG. 1.
Figure 3:
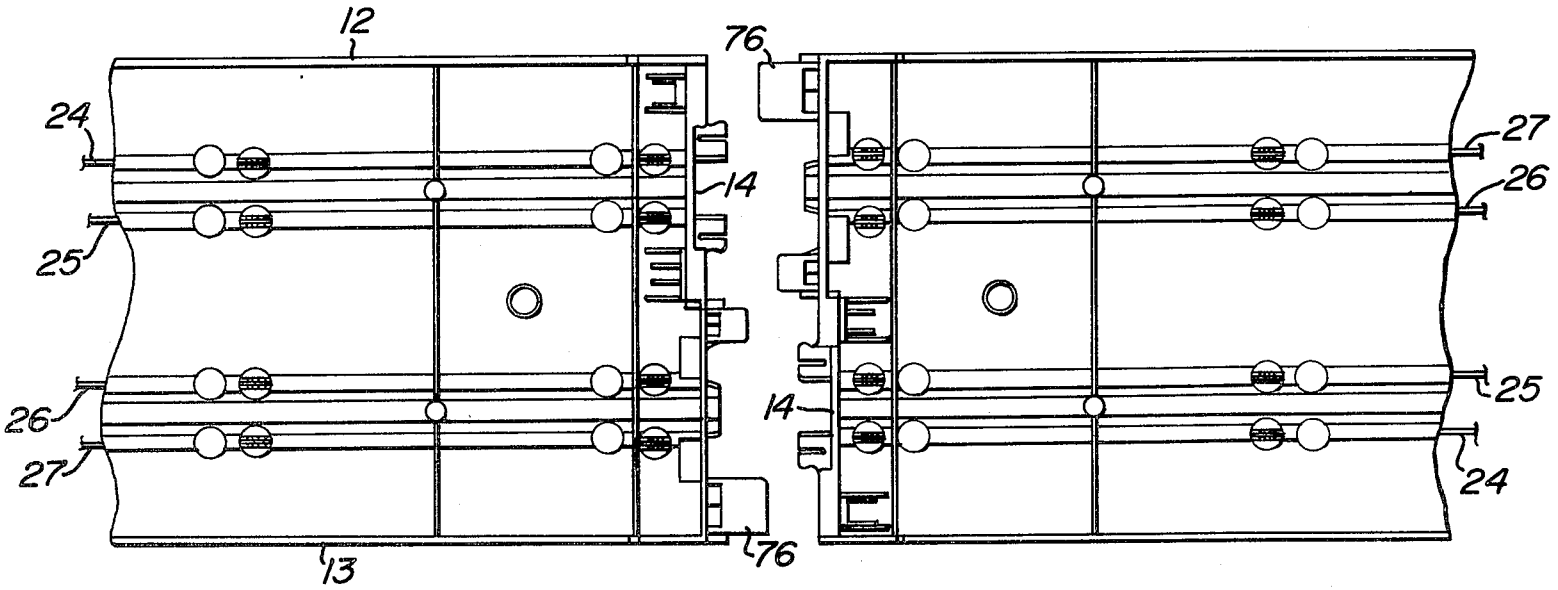
FIG. 3 is a bottom plan view of the track sections of FIGS. 1 and 2 in a disconnected condition.

Referring now more particularly to the drawings, and specifically to FIGS. 1 and 4 thereof, a pair of substantially identical model track sections are each there generally designated 10, each track section having its oppposite ends identical, so that only a single end need be shown and described.

Each track section 10 may include a generally elongate substantially flat bed or body 11 which may have on opposite side edges a pair of longitudinally extending sides or walls 12 and 13, and along each end extending laterally there across an end wall 14. The underside may be of any suitable construction, say hollow with strengthening ribs, as desired. The upper, generally flat surface 15 of body 11 provides a supporting surface for a vehicle moving along the body. The body 11 may be formed with a pair of generally parallel, longitudinally extending guiding formations or grooves 18 and 19 facing upwardly for slidably receiving the depending guide member of a moving vehicle, which guideways or grooves open longitudinally outwardly through opposite ends of the body 11. Also formed in the upper model vehicle supporting surface 15, on opposite sides of the guideways or grooves 18 and 19 are upwardly opening grooves or recesses receiving fixed rails or strips of conductive material. More particularly, a pair of generally parallel, longitudinally extending open ended grooves 20 and 21 are formed in the body 15, respectively on opposite ends of the guideway 18 and opening through opposite ends of the body. On opposite sides of the guideway or groove 19, there are similarly provided a pair of upwardly opening, longitudinally extending, open ended rail receiving recesses or grooves 22 and 23. A pair of elongate conductive metal strips, say of suitably resilient material, are respectively engaged in grooves 20 and 21, as at 24 and 25, the strips being suitably secured in position, as by staking, or the like. Similarly secured in position in respective grooves 22 and 23 are resilient, conductive metal strips 26 and 27.

While position securement of the metal strips or rails 24–27 in their respective grooves 20–23 may be desirable under certain conditions, the rails or strips may be retained in their grooves by friction of the resiliently deflected strips against the grooves side walls, as will appear more fully hereinafter.

The body 11 is provided with a longitudinal end extension, formation, or projection 30, which may include an extension of groove 19 and adjacent body material located generally between grooves 22 and 23. Further, the strip receiving grooves 22 and 23 include, adjacent to the body formation or extension 30, a pair of laterally outwardly offset groove portions 31 and 32, and oblique connection portions 33 and 34. That is, the connection portion 33 extends obliquely laterally outwardly from the main portion of groove 22 to its laterally outwardly offset portion 31, and similarly the oblique connecting groove portion 34 extends from the main portion of its groove 23 to the outwardly offset portion 32. The outwardly offset groove portions 31 and 32 terminate short of the body end 14 and formation 30, and extend toward the same by oblique, laterally inwardly extending portions 35 and 36. That is, the laterally outwardly offset groove portion 31 extends laterally inwardly through oblique groove portion 35 toward and terminates proximate to the end wall 14, while laterally outwardly offset groove portion 32 extends laterally obliquely inwardly and terminates adjacent to body end 14, as by groove portion 36. The oblique groove portions 35 and 36 thus terminate in open ends opening generally through body end 14 proximate to and on opposite sides of the extending formation 30. The extending formation 30 has its opposite sides 37 and 38 as respective extensions of the inner sides of grooves 35 and 36, being disposed at an obtuse angle with respect thereto. The opposite sides 37 and 38 of extending formation 30 may be generally parallel and, as the body end 14 and groove portions 35 and 36 terminate just short of the formation 30, the opposite sides thereof face laterally outwardly in opposite directions toward unoccupied spaces, in the disconnected condition.

The groove portions 33, 31 and 35 of groove 22 may be slightly wider than the thickness of strip 26, so that the strip may be readily curved or bent and inserted into the groove portions without permanent deformation or distortion of the strip.

Thus, the strips 24–27 may be substantially straight in their undeflected condition and are readily deflectable for engagement in respective grooves without deformation of the strips.

Further, the end portion 39 of strip 26 extends through the oblique groove portion 35 outward beyond the open end thereof and along formation side 37 to terminate at a free end 40 proximate to the formation side 37. As appears in the drawings, the side wall or surface 37 of formation 30 is disposed generally longitudinally of the body 11, being parallel to the longitudinal axis thereof, and merges at a juncture 41, see FIG. 1, with the inner wall of groove portion 35 at an obtuse angle of less than 180°. This internal angle at the juncture 41 defines a concavity 42 generally on the side of and facing laterally outwardly from the formation 30. The end portion 39 of strip 26 extends obliquely across the concavity 42, and may be considered as extending obliquely inwardly from its outer end 40 at the side 37 of formation 30 toward and into the groove portion 35 of body 11. The outer side of groove portion 35 terminates in an end or bearing region 43 generally opposite to the concavity 42 and juncture 41, and is in bearing engagement with the resilient strip portion 39 to maintain the strip end 40 against the formation side 37 and hold the strip portion in its oblique disposition extending across the concavity 42. From the strip end portion 39, the strip extends inwardly and arcuately, as at strip portion 44 located in laterally outwardly offset groove portion 31, being in bearing engagement with external juncture point 45 of angulate groove portions 35 and 31, and in bearing engagement with external juncture point 46 of angulate groove portions 31 and 32. Also, the strip 26 may be in bearing engagement with external juncture point 47 of groove portion 33 and the adjacent longitudinal portion of groove 22.

It will now be appreciated that the obliquely disposed strip end portion 35 may be considered as a resilient leaf spring, being resiliently deflectable laterally inwardly toward the concavity 42, the strip end region 40 being free to slide on formation side 37. Also, it will be observed that the formation side 37 is located laterally closer to the guideway or groove 19 than the strip receiving groove 22, so that the strip end portion 40 is located closer to the guideway or groove 19 than the main portion 26 of the conductive strip.

The conductive strip 27 is similarly arcuately bent within its elastic limit within portion 34 of groove 23. Thus, the strip 27 terminates in a free end region 50 extending obliquely with respect to the longitudinal direction of body 11 on the opposite side of formation 30 as strip end portion 40 and in bridging relation across an angular concavity 52 corresponding to the cavity 42.

A generally acute angular formation or bearing point 53 deflects the strip end portion 50 into its oblique position extending into engagement with the side surface 38 of formation 30.

From the oblique resilient strip end portion 50, the strip extends through outwardly offset groove portion 32, being smoothly arcuate therein and may be in engagement with bearing points 55 and 56, as well as bearing point 57, maintaining the arcuate configuration.

In the illustrated embodiment the extending formation 30 and its associated, obliquely disposed resilient means or strip end portions 39 and 50 may be considered a male formation, and the opposite end of resilient metal strips 26 and 27 at the opposite end of body 11 may be provided with a female formation for detachable connection with like track sections in male-to-female end engagement. Of course, each track end region may be provided with both male and female formations, as illustrated herein, thus being hermaphroditic for detachable end-to-end connection with either end of a like track section.

Such an arrangement is shown in the drawings, wherein the guideway or groove 18 terminates at body end 14, the body end being provided with a pair of end extensions 60 and 61 spaced on opposite sides of the guide groove 18, being respectively outward of and flush with the outer side of strip receiving grooves 20 and 21. That is, the inner side of extension 60, as at 62, may be a generally flush extension of the outer side of groove 20, while the inner side 63 of extension 61 may be a flush extension of the outer side of groove 21. The respective conductive metal strips 24 and 25 extend beyond their respective grooves 20 and 21, terminating in end portions 64 and 65 respectively located along facing extension sides 62 and 63. Thus, the strip end extension 64 and 65 are generally parallel to each other and the longitudinal axis of body 11, being in laterally spaced facing relation with respect to each other, and are spaced apart a distance slightly greater than the spacing of strip ends 40 and 50, for a purpose appearing presently.

It will now be appreciated that the strip end portions 40, 50, 64 and 65 each extend generally longitudinally along an adjacent body formation, and do not extend therebeyond. This eliminates or minimizes the possibility of electrical hazard by short circuiting, as well as the mechanical hazard of sharp projections.

The combinative relationship of the extending portions 60 and 61 extending beyond the intermediate body region, and the extending end portions 64 and 65 of strips 24 and 25 also extending beyond the intermediate body region may serve as a female formation for interengagement with a male formation, as described hereinbefore, of another like track section. Of course, it is appreciated that the grooves 22 and 23 are continuous, as are their received strips 26 and 27, terminating at the opposite end in a formation identical to that at the ends of grooves 20 and 21 receiving strips 24 and 25.

Spaced on opposite sides of the formation 30 and its oblique resilient strip portions or leaves 38 and 39 are a pair of end extensions 70 and 71, each having an oblique inner edge, as at 72 and 73, respectively, adjacent to and converging inwardly toward the formation 30. The generally convergent oblique surfaces 72 and 73 terminate in undercuts 74 and 75, respectively, adjacent to the body end 14. A lug 76 projects generally longitudinally outwardly from the outer end of extension 71. The extensions 60 and 61 are provided on their outer sides remote from the strip end portions 64 and 65 with longitudinally outwardly convergent sides 77 and 78, respectively, terminating at their outer ends in lateral protuberances 79 and 80. The extensions 60 and 61 are each split or bifurcated, as by cuts 81 and 82, which serve to define of the laterally outer portions 83 and 84 resiliently laterally deflectable fingers, for a purpose appearing presently.

The projection 70 may also be provided with a longitudinally outstanding lug 85, while the body end wall may be provided, as at 86 and 87 with lug receiving formations for receiving respective lugs 85 and 76 of a like track section. The material of bed 15 over each receiving formation or slot 87 is cut or slit, as by a pair of generally parallel spaced slots 88 extending longitudinally inwardly and combining to define of the material therebetween a resilient finger 89. Viewed otherwise, the lug receiving formations or slots 87 formed in end wall 14 are each bounded on its upper side by a vertically resiliently deflectable finger 89, which may include on its free end a depending lip 90, best seen in FIG. 5. The lower side of each receiving formation or slot 87 may be provided with a laterally extending, outstanding flange 91, and a slot end wall 92 connecting the flange 91 to the bed 15. The flange 91 serves as a guide for constraining the lug or tongue 76 to longitudinal entry into slot 87. On the upper side of lug or tongue 76 may be a protrusion 93 for snap engagement beneath and retention by lip 90, the inserted condition shown in FIG. 5. That is, the upward protrusion 93 combines with the depending lip 90 and the vertically resillient deflectability of finger 89 to achieve snap interengagement and releasable holding of tongue 76 in slot 87.

Thus, while longitudinal guiding of like track sections 10 is effected by interengagement of tongues 76 in slots 87, releasable retention therein is effected by vertical resilient displacement of fingers 89 into snap engagement with protrusions 93 on tongue 76. Conversely, snap interengagement of extensions 60 and 61 into releasably retained relation is effected with extensions 70 by horizontal or lateral deflection of fingers 83 and 84 into snap interengagement with laterally convergent sides 77 and 78.

As best seen by comparison of FIGS. 1 and 4, the like track sections have substantially identical ends and are movable along their aligned longitudinal axes into and out of interfitting engagement. The lugs 76 and 85 will engage in the lug receiving formations 87 and 86, respectively. The formation 30 and adjacent resilient leaves 39 and 49 enter between the extending portions 60 and 61 of the other track section, which extending portions enter between the formation 30 and projections 71 and 70. More specifically, the lateral protrusions 79 and 80 of the extensions 60 and 61 ride on inclined sides 73 and 72, being deflected thereby and snap into respective undercuts 75 and 74. Simultaneously, longitudinal strip end portions 64 and 65 will rub along and laterally inwardly deflect strip end portions 49 and 39 toward their respective adjacent concavities 52 and 42. This rubbing action between strip end portions and resilient deflection insures clean effective electrical contact therebetween. Disconnection of the track sections is effected by mere longitudinal separation to withdraw the parts which assume their original configuration.

From the foregoing it will now be understood that the track section of the present invention is extremely simple in construction and operation, capable of economic manufacture, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A track section for a model vehicle, said track section comprising a generally flat longitudinally elongate body having an upper vehicle supporting surface, a first formation on each end of said body having one side facing generally laterally, resilient means on said one side of each first formation disposed oblique to said body and deflectable laterally toward the associated first formation, a complementary formation on each end of said body configured to cooperate with the one side of the first formation of a like track section for deflectable engagement with said resilient means upon longitudinally aligned relative movement between said first mentioned and like track sections, guide means on each end of said body for guiding engagement with like guide means of the like track section to constrain the first mentioned and like track sections to longitudinally aligned relative movement, and releasably interengageable retaining means on each end of said body for interfitting engagement with like retaining means of the like track section, said first formations each having its other side facing generally laterally, additional resilient means on said other side of each first formation disposed oblique to said body and deflectable laterally toward the associated first formation, and an additional complementary formation on each end of said body configured to cooperate with the other side of the first formation of a like track section for deflectable engagement with said additional resilient means upon longitudinally aligned relative movement between said first mentioned and like track sections, said upper body surface being formed with a pair of continuous upwardly facing grooves each having one end opening along a respective side of said first formation and its other end opening along a respective one of said first mentioned and additional complementary formations, and said first mentioned and additional resilient means each comprising an integral continuous conductive strip received in a respective groove with its opposite ends extending beyond the opposite ends of the receiving groove for respective engagement with the like strips of a like track section, said grooves being sufficiently straight to receive said strips without permanently deforming the latter.

2. A track section for a model vehicle, said track section comprising a generally flat longitudinally elongate body having an upper vehicle supporting surface, a first formation on each end of said body having one side facing generally laterally, resilient means on said one side of each first formation disposed oblique to said body and deflectable laterally toward the associated first formation, a complementary formation on each end of said body configured to cooperate with the one side of the first formation of a like track section for deflectable engagement with said resilient means upon longitudinally aligned relative movement between said first mentioned and like track sections, guide means on each end of said body for guiding engagement with like guide means of the like track section to constrain the first mentioned and like track sections to longitudinally aligned relative movement, and releasably interengageable retaining means on each end of said body for interfitting engagement with like retaining means of the like track section, said first formations each having its other side facing generally laterally, additional resilient means on said other side of each first formation disposed oblique to said body and deflectable laterally toward the associated first formation, and an additional complementary formation on each end of said body configured to cooperate with the other side of the first formation of a like track section for deflectable engagement with said additional resilient means upon longitudinally aligned relative movement between said first mentioned and like track sections, said upper body surface being formed with a pair of continuous upwardly facing grooves each having one end opening along a respective side of said first formation and its other end opening along a respective one of said first mentioned and additional complementary formations, and said first mentioned and additional resilient means each comprising an integral continuous conductive strip received in a respective groove with its opposite ends extending beyond the opposite ends of the received groove for respective engagement with the like strips of a like track section, said strips being substantially straight in undeflected condition and deflected in said grooves by the groove configuration without permanent deformation.

3. A track section according to claim 2, said strips each being of substantially constant cross section throughout its length.

* * * * *